US011708743B2

(12) United States Patent
Leducq

(10) Patent No.: US 11,708,743 B2
(45) Date of Patent: Jul. 25, 2023

(54) UNIVERSAL WIRELESS ACTUATOR FOR SURFACE-CONTROLLED SUBSURFACE SAFETY VALVE

(71) Applicant: Schlumberger Technology Corporation, Sugar Land, TX (US)

(72) Inventor: Paul Leducq, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 105 days.

(21) Appl. No.: 17/319,460

(22) Filed: May 13, 2021

(65) Prior Publication Data

US 2022/0364436 A1 Nov. 17, 2022

(51) Int. Cl.
*E21B 34/10* (2006.01)
*E21B 23/02* (2006.01)

(52) U.S. Cl.
CPC ..... *E21B 34/102* (2013.01); *E21B 23/02* (2013.01); *E21B 2200/05* (2020.05)

(58) Field of Classification Search
CPC ..... E21B 34/12; E21B 23/02; E21B 2200/05
See application file for complete search history.

(56) References Cited

U.S. PATENT DOCUMENTS 4,002,202 A * 1/1977 Huebsch ..... E21B 31/03 137/498
4,191,248 A * 3/1980 Huebsch ..... E21B 34/066 335/267
5,358,035 A 10/1994 Grudzinsk
5,996,687 A * 12/1999 Pringle ..... E21B 34/06 251/117
6,619,388 B2 * 9/2003 Dietz ..... E21B 34/066 166/66
6,799,633 B2 * 10/2004 McGregor ..... B23K 3/0623 340/854.4
7,108,073 B2 * 9/2006 Patel ..... E21B 34/063 166/386
7,363,980 B2 * 4/2008 Pringle ..... E21B 34/08 166/332.8
7,721,805 B2 * 5/2010 Hill ..... E21B 34/14 166/305.1
7,967,074 B2 * 6/2011 Lake ..... E21B 34/066 251/30.01

(Continued)

FOREIGN PATENT DOCUMENTS

EP 2878762 A1 6/2015
WO 0017482 A1 3/2000

OTHER PUBLICATIONS

International Search Report and Written Opinion issued in PCT Application PCT/US2022/027565 dated Sep. 7, 2022, 11 pages.

*Primary Examiner* — Aaron L Lembo
(74) *Attorney, Agent, or Firm* — Jeffrey D. Frantz

(57) ABSTRACT

Apparatus and methods pertaining to an adapter mechanically connecting a wireless actuator to an SCSSV subassembly that includes an SCSSV. The adapter mechanically connects to the SCSSV subassembly so that the adapter is situated uphole of the SCSSV subassembly when set in a tubular of a wellbore. An actuating piston is carried by the adapter. The actuating piston transfers an opening force to the SCSSV in response to receipt by the adapter of pressurized fluid from the wireless actuator, thereby opening a flapper of the SCSSV.

18 Claims, 5 Drawing Sheets

(56) References Cited

U.S. PATENT DOCUMENTS

| | | | | |
|---|---|---|---|---|
| 8,220,534 | B2 | 7/2012 | Millet et al. | |
| 9,140,101 | B2 * | 9/2015 | Scott | E21B 43/128 |
| 9,359,859 | B2 * | 6/2016 | Ross | E21B 34/16 |
| 9,441,456 | B2 * | 9/2016 | Hill, Jr. | E21B 34/102 |
| 9,745,830 | B2 * | 8/2017 | Lake | E21B 34/14 |
| 9,909,387 | B2 * | 3/2018 | Scott | E21B 23/02 |
| 11,015,418 | B2 * | 5/2021 | Burris | E21B 34/105 |
| 2002/0108747 | A1 | 8/2002 | Dietz et al. | |
| 2009/0032238 | A1 * | 2/2009 | Rogers | E21B 34/066 166/332.8 |
| 2015/0211333 | A1 * | 7/2015 | Vick, Jr. | E21B 34/066 166/375 |
| 2015/0275620 | A1 | 10/2015 | Scott et al. | |
| 2015/0300124 | A1 * | 10/2015 | Mailand | E21B 34/102 166/332.8 |

* cited by examiner

UNIVERSAL WIRELESS ACTUATOR FOR SURFACE-CONTROLLED SUBSURFACE SAFETY VALVE

BACKGROUND OF THE DISCLOSURE

Most production wells are equipped with a surface-controlled subsurface safety valve (SCSSV) representing the last barrier before a blow-out preventer (BOP) against uncontrolled oil and/or gas flow from a reservoir. The SCSSV is actuated (opened or closed) via, for example, a hydraulic conduit ("control line") that is either run into the well or tied into the completion. The control line is pressurized via a surface pump (e.g., located on the rig floor).

The control line is a common cause of failure of the SCSSV. Upon such failure, well production is halted to repair the control line, often via intervention of a workover rig. Such repairs are expensive, and also result in substantial financial losses attributable to delayed production.

Wireless SCSSVs have been developed in the past and have been described in the prior art, such as in U.S. Pat. No. 8,220,534. Such SCSSV includes a receiver for receiving a signal coming from a control unit, such as for holding a shutter in an open position upon reception of a signal coming from the surface with the help of a hydraulic cylinder that actuates holding means. The SCSSV is an assembly with a specific design including the valve housing, the receiver, the control unit, and the hydraulic cylinder. The receiver and control unit are situated downhole from the valve and the shutter, whereas the hydraulic cylinder is situated uphole from the shutter.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes an adapter mechanically connecting a wireless actuator to an SCSSV subassembly that includes an SCSSV. The adapter mechanically connects to the SCSSV subassembly so that the adapter is situated uphole of the SCSSV subassembly when set in a tubular of a wellbore. The apparatus also includes an actuating piston carried by the adapter. The actuating piston transfers an opening force to the SCSSV in response to receipt by the adapter of pressurized fluid from the wireless actuator, thereby opening a flapper of the SCSSV.

The present disclosure also introduces a system including an SCSSV subassembly having an SCSSV, a fluid passage, and a flapper. The flapper is movable between an open position in which the flapper opens the fluid passage and a closed position in which the flapper closes the fluid passage. The system also includes a wireless actuator that includes a hydraulic actuator and a control unit for controlling the hydraulic actuator based on wireless signals received via a receiver electrically connected to the control unit. The system also includes an adapter mechanically connecting the wireless actuator to the SCSSV subassembly. The adapter mechanically connects to the SCSSV subassembly so that the adapter is situated uphole of the SCSSV subassembly when set in a tubular of a wellbore. The system also includes an actuating piston carried by the adapter. The actuating piston transfers an opening force to the SCSSV in response to receipt by the adapter of pressurized fluid from the wireless actuator, thereby moving the flapper to the open position.

The present disclosure also introduces a method that includes transmitting a wireless signal to a wireless actuator in a tubular of a wellbore, thereby causing the wireless actuator to communicate pressurized fluid to an adapter. The adapter mechanically connects the wireless actuator to an SCSSV subassembly that includes an SCSSV. The adapter includes an actuating piston that transfers an opening force to the SCSSV in response to receipt by the adapter of the pressurized fluid from the wireless actuator, thereby opening the SCSSV.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
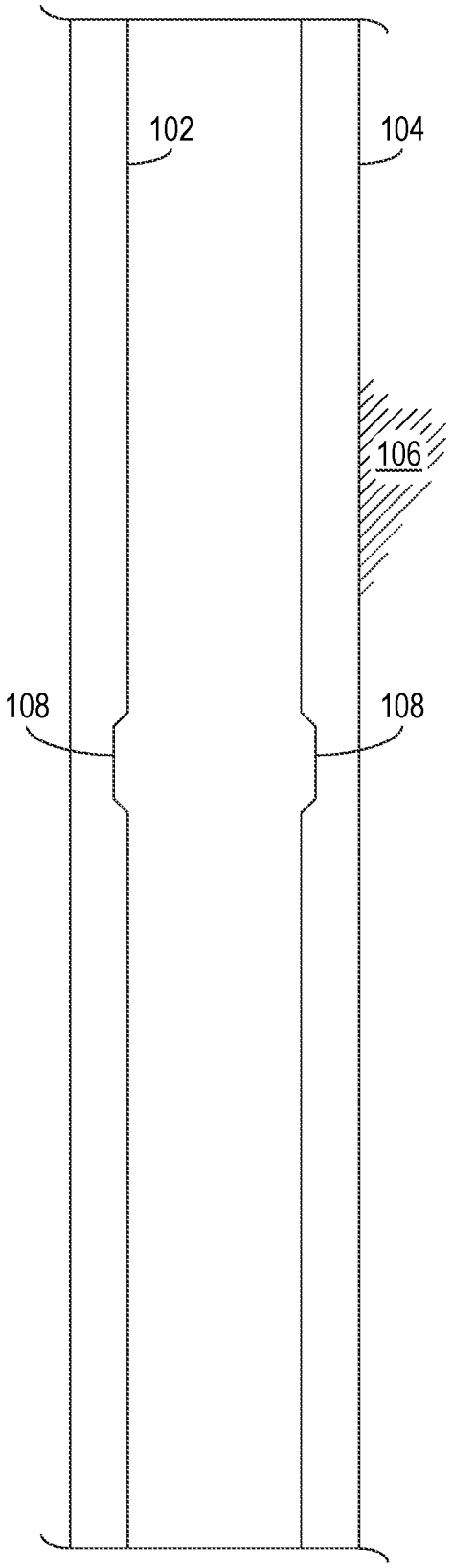
FIG. 1 is a schematic view of a portion of an example implementation of a tubular extending into a subterranean formation according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of a portion of an example implementation of a tubular 102 installed in a wellbore 104. The wellbore 104 extends into one or more subterranean formations 106 and may fully cased, partially cased, or open hole. However, for ease of clarity and understanding, the wellbore 104 will not be further described herein, nor shown in the subsequent figures, it being understood that aspects of the present disclosure generally pertain to subterranean wellbores for oil and/or gas and/or water and/or steam exploration and/or production purposes.

The tubular 102 may be production tubing and/or other types of tubulars coupled end-to-end. The illustrated portion of the tubular 102 depicted in FIG. 1 includes an anchoring recess 108 to be utilized for anchoring various downhole equipment within the tubular 102. The anchoring recess 108 may extend circumferentially around the inner surface of the tubular102. In other implementations also within the scope of the present disclosure, the tubular 102 may not comprise an anchoring recess 108, or the anchoring recess 108 may comprise more than one recess axially spaced apart and having the same or different cross-sectional profiles.

Figure 2:
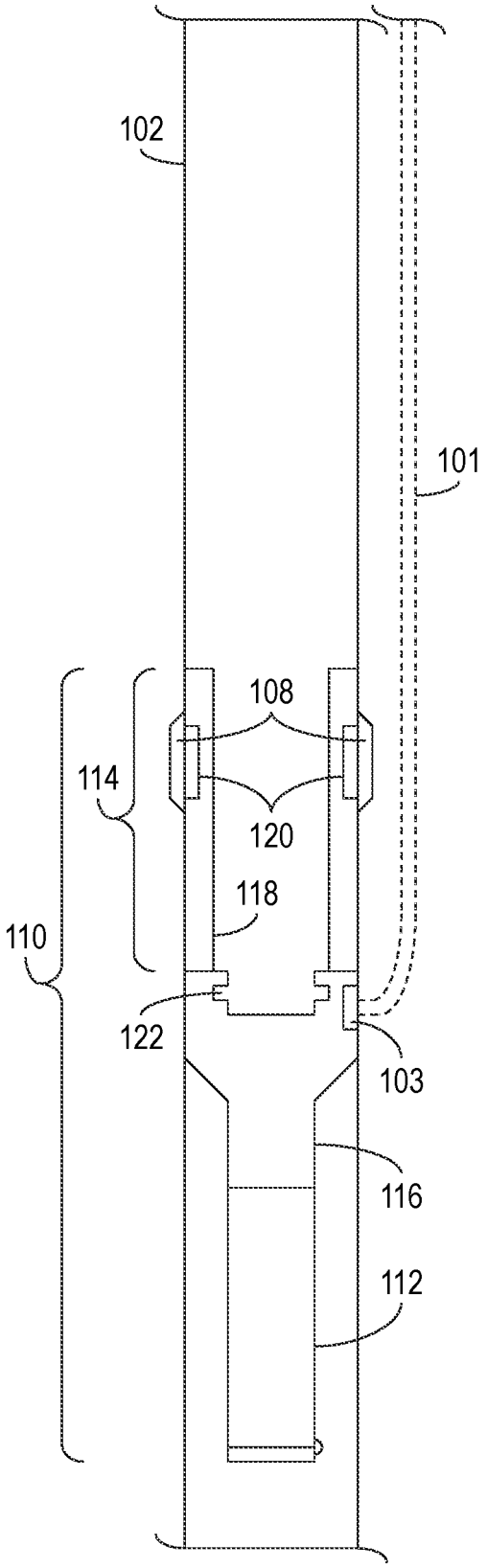
FIG. 2 is a schematic view of at least a portion of an example implementation of apparatus installed in the tubular shown in FIG. 1 according to one or more aspects of the present disclosure.

In FIG. 2, an SCSSV subassembly 110 has been conveyed within and positioned for anchoring to the tubular 102. The SCSSV subassembly 110 comprises an SCSSV 112, an anchor subassembly 114, and a crossover 116 coupling the SCSSV 112 with the anchor subassembly 114.

The SCSSV 112 is not operable by wireless actuation, whether by design or by existing circumstances. In the context of the present disclosure, "wireless" actuation means that the SCSSV 112 can be actuated in the absence of a functioning conventional hydraulic control line. For example, FIG. 2 also includes dashed lines depicting a conventional hydraulic control line 101 to demonstrate that the SCSSV subassembly 110, or at least the SCSSV 112, may be or consist of commercial-off-the-shelf (COTS) components intended to operate in conjunction with a conventional hydraulic control line 101 that controls the SCSSV by circulating a fluid in the hydraulic control line, such fluid enabling operation of the valve. However, the SCSSV 112 may not have been originally intended to be utilized with a conventional hydraulic control line 101, or may have been previously installed in the well and subsequently made inoperable due to damage to the control line 101 and/or causes of hydraulic leakage. Thus, the conventional hydraulic control line 101 is depicted in FIG. 2 by dashed lines merely to demonstrate this component as an example of conventional SCSSV failure, and it is to be understood that the SCSSV subassembly 110 according to aspects of the present disclosure may not include or be utilized with the conventional hydraulic control line 101, although the SCSSV subassembly 110 may nonetheless comprise a port and/or other means 103 for connecting with a conventional hydraulic control line 101.

The anchor subassembly 114 may comprise a lock mandrel 118 comprising a plurality of locking members 120 each extendable into the anchoring recess(es) 108 of the tubular 102. The crossover 116 and/or other portion(s) of the SCSSV subassembly 110 comprises one or more recesses 122 for receiving locking/engagement members described below. The anchor subassembly 114 may also comprise the lock mandrel 118 in a manner permitting anchoring the SCSSV subassembly 110 at other locations within the tubing 102 that do not comprise the recess 108 and/or other means specifically designed for such anchoring.

Figure 3:
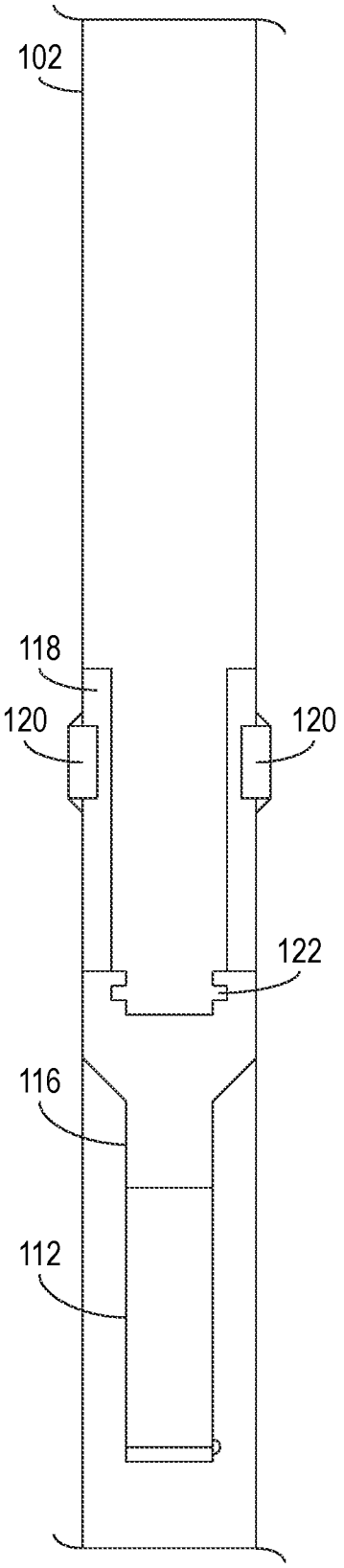
FIG. 3 is a schematic view of the apparatus shown in FIG. 2 in a subsequent stage of installation according to one or more aspects of the present disclosure.

In FIG. 3, the locking members 120 have been engaged with the anchoring recess 108. Such engagement may be via corresponding springs and/or other biasing members (not shown) urging the locking members 120 radially outward into the anchoring recess 108. However, the lock mandrel 118 may comprise electrical, hydraulic, and/or other means for actively causing the locking members 120 to move radially outward into the anchoring recess 108.

Figure 4:
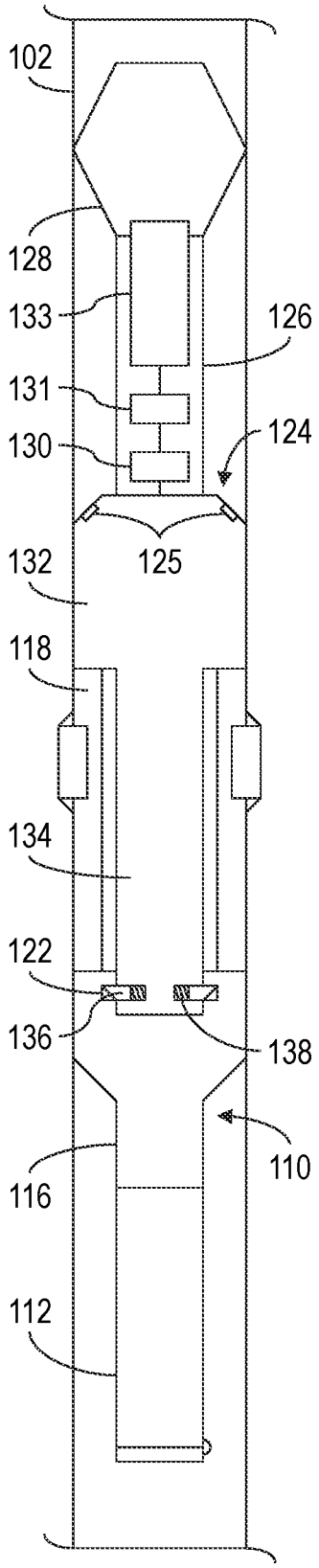
FIG. 4 is a schematic view of at least a portion of an example implementation of additional apparatus assembled with the apparatus shown in FIG. 3 according to one or more aspects of the present disclosure.

In FIG. 4, an adapter 124 has been conveyed within the tubular 102 and positioned for mechanically and possibly hydraulically coupling with the SCSSV subassembly 110. Prior to such conveyance, the adapter 124 may have been coupled (mechanically, electrically, and/or hydraulically) with a wireless actuator 126. The wireless actuator 126 includes a hydraulic pump and/or other actuator 130 and a control unit 131 that permits controlling the hydraulic actuator 130 without a control line (e.g., control line 101) via wireless signals, and possibly a receiver 133 for receiving such wireless signals. The wireless actuator 126 may be connected between the adapter 124 and a centralizer 128. The centralizer 128 is connected (mechanically, electrically, and/or otherwise) to the wireless actuator 126 to radially centralize the wireless actuator 126 and the adapter 124 within the tubular 102. The centralizer 128 may also include a portion or the entirety of the receiver 133 for enhancing communication with the surface, such as by ensuring good contact with the tubular 102 in implementations in which the wireless signals are conveyed via the tubular 102. The hydraulic actuator 130 is designed to be operated by the control unit 131 based on the wireless signals received by the receiver 133 from surface equipment to operate the hydraulic actuator 130 and provide an opening force to the SCSSV 112. The wireless signals may include electromagnetic (EM) and/or acoustic signals conveyed via the tubular 102 itself and/or fluid in the tubular 102.

The adapter 124 comprises an upper portion 132 and a lower portion 134. Conveying the centralizer 128, the wireless actuator 126, and the adapter 124 includes positioning the lower portion 134 to extend to within the anchor subassembly 114, the crossover 116, and/or other portion(s) of the SCSSV subassembly 110. For example, such positioning may permit a plurality of locking members 136 of the lower adapter portion 134 to each extend into the recess 122 of the crossover 116 and/or other portion of the SCSSV subassembly 110. In other implementations also within the scope of the present disclosure, the locking members 136 may be carried with the crossover 116 and extend in a corresponding outer recess of the adapter 124. The locking members 136 are depicted in the figures as being biased into engagement with the recess 122 by corresponding springs and/or other biasing members 138, although other implementations are also within the scope of the present disclosure.

In the example implementation shown in FIGS. 2-4, the crossover 116 may be a specific crossover that permits engaging the adapter 124 with the SCSSV 112.

Figure 5:
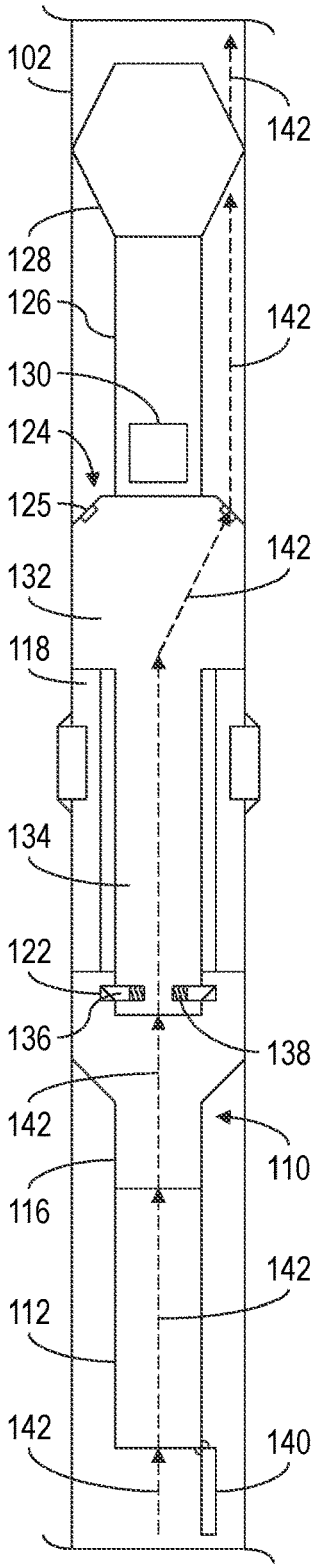
FIG. 5 is a schematic view of the apparatus shown in FIG. 4 in a subsequent stage of operation according to one or more aspects of the present disclosure.

In FIG. 5, the wireless actuator 126, in response to receipt of a wireless signal, has activated the hydraulic pump 130. An actuating piston (not shown) carried by the adapter 124 has transferred hydraulic pressure to the SCSSV 112 in response to the receipt of pressurized fluid from the hydraulic pump 130, thereby opening a flapper 140 of the SCSSV 112. The opened SCSSV 112 permits a flow path 142 extending through the SCSSV 112, the crossover 116, and the adapter 124 (e.g., via exit ports 125), then around the wireless actuator 126 and around (or through) the centralizer 128, such that fluid in the tubular 102 downhole of the SCSSV 112 may flow uphole to the wellsite surface.

Various means may be utilized within the scope of the present disclosure for transferring the hydraulic pressure created by the hydraulic pump 130 to a mechanism of the SCSSV 112 in order to open the flapper 140. An example implementation thereof is at least partially depicted in the sectional views shown in FIGS. 6-8.

Figure 6:
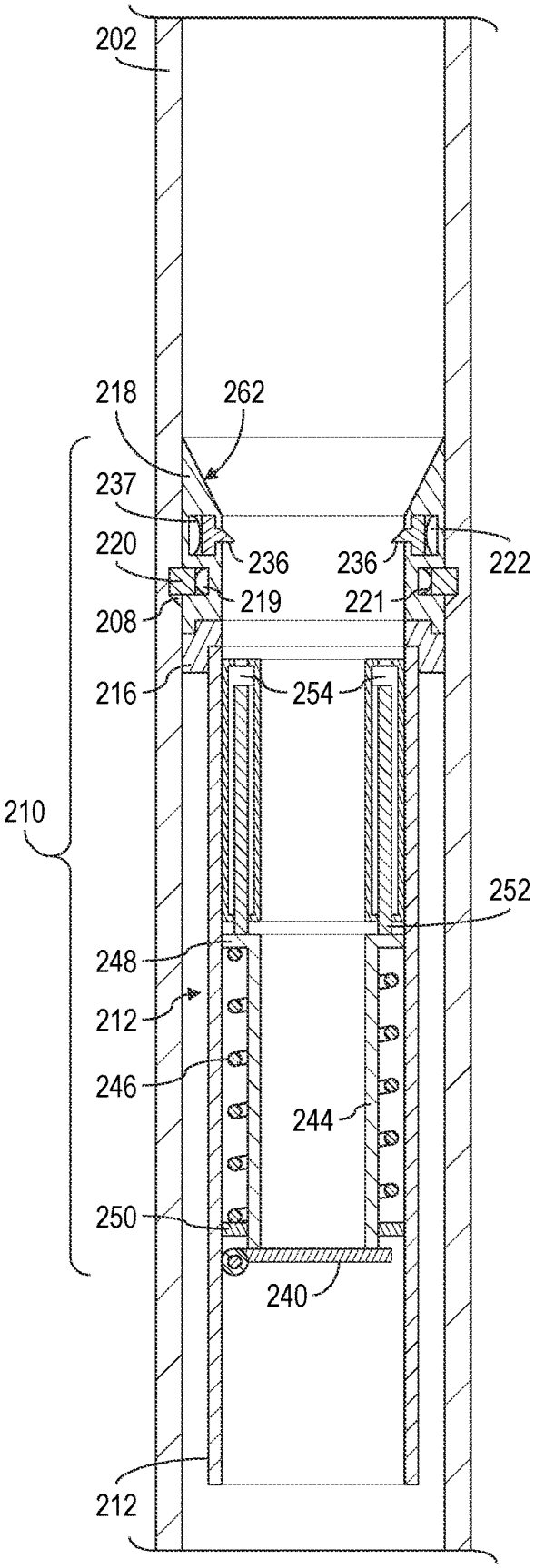
FIG. 6 is a sectional view of at least a portion of another example implementation of the apparatus shown in FIG. 3 according to one or more aspects of the present disclosure.

In FIG. 6, an SCSSV subassembly 210 has been conveyed within and anchored to a tubular 202. The SCSSV subassembly 210 comprises a lock mandrel 218 having locking members 220 slidable within outer recesses 219 and biased (e.g., via Belleville or other compression spring members 221) into engagement with an inner recess 208 of the tubular 202. Except as explicitly described herein, the SCSSV subassembly 210 is otherwise at least similar to the SCSSV subassembly 110 described above, such that the tubular 202, the recess 208, the lock mandrel 218, and the locking members 220, except as explicitly described herein, are otherwise at least similar to the tubular 102, the recess 108, the lock mandrel 118, and the locking members 120 described above.

An SCSSV 212 is mechanically coupled to the lock mandrel 218 by a crossover 216. Except as described herein, the SCSSV 212 and the crossover 216 are otherwise at least similar to the SCSSV 112 and the crossover 116 described above. For example, the SCSSV 212 is a conventional SCSSV, ie not operable by wireless actuation and/or may be or consist of COTS components.

The lock mandrel 218 (or an anchor subassembly comprising the lock mandrel 218 and at least similar to the anchor subassembly 114 described above) comprises a plurality of engagement members 236. Each engagement member 236 is slidingly disposed within a corresponding recess 222 and is biased radially inward by, for example, Belleville or other compression spring members 237.

The SCSSV 212 comprises a flapper 240 that is biased (e.g., by a torsion spring and/or other biasing means, not shown) toward a closed position, as depicted in FIG. 6. In the closed position, the flapper 240 closes a downhole end of a flow tube 244, thus preventing the flow of fluid uphole into the SCSSV 212. The flow tube 244 is biased to a closed position, as depicted in FIG. 6, by a compression spring 246 and/or other biasing means extending between a flange 248 extending radially outward from the flow tube 244 and a stop 250 through which the flow tube 244 can slide.

Figure 8:
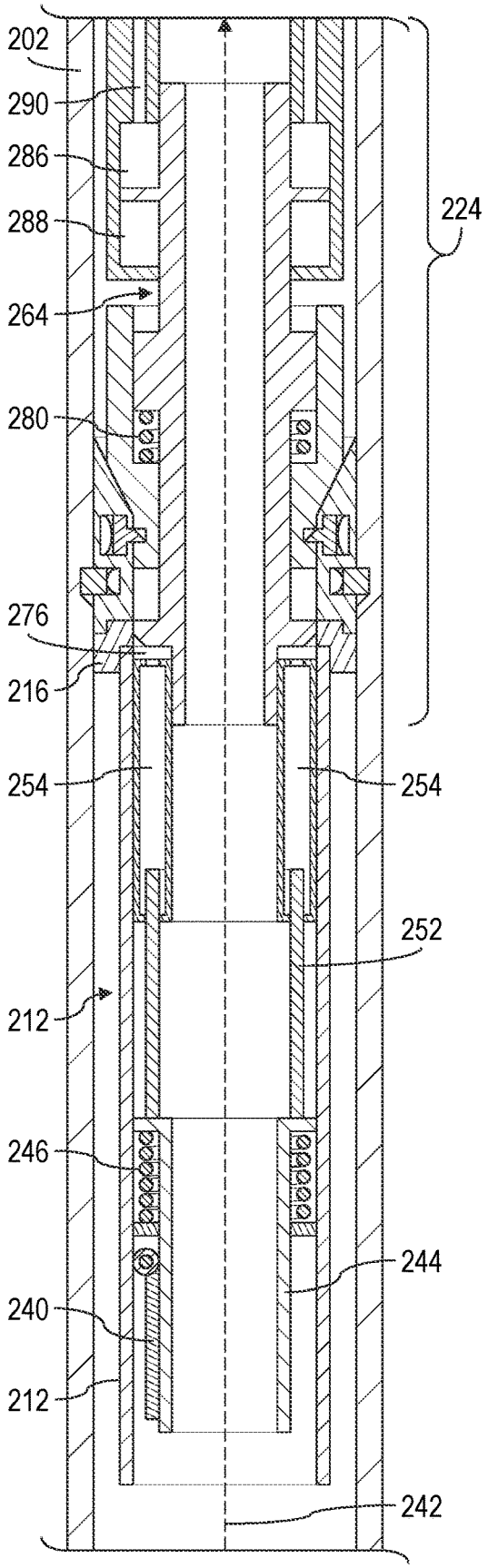
FIG. 8 is a sectional view of the apparatus shown in FIG. 7 in a subsequent stage of operation, representing another example implementation of the apparatus shown in FIG. 5, according to one or more aspects of the present disclosure.

The flow tube 244 is movable in response to hydraulic pressure. For example, the SCSSV 212 may comprise an annular piston 252 hydraulically extendable from an annular pressure chamber 254 to overcome the biasing force of the spring 246 and push the flow tube 244 through the stop 250 and rotate the flapper 240 away from the closed position (as depicted in FIG. 8). However, other means for hydraulically operating the SCSSV 212 are also within the scope of the present disclosure.

Figure 7:
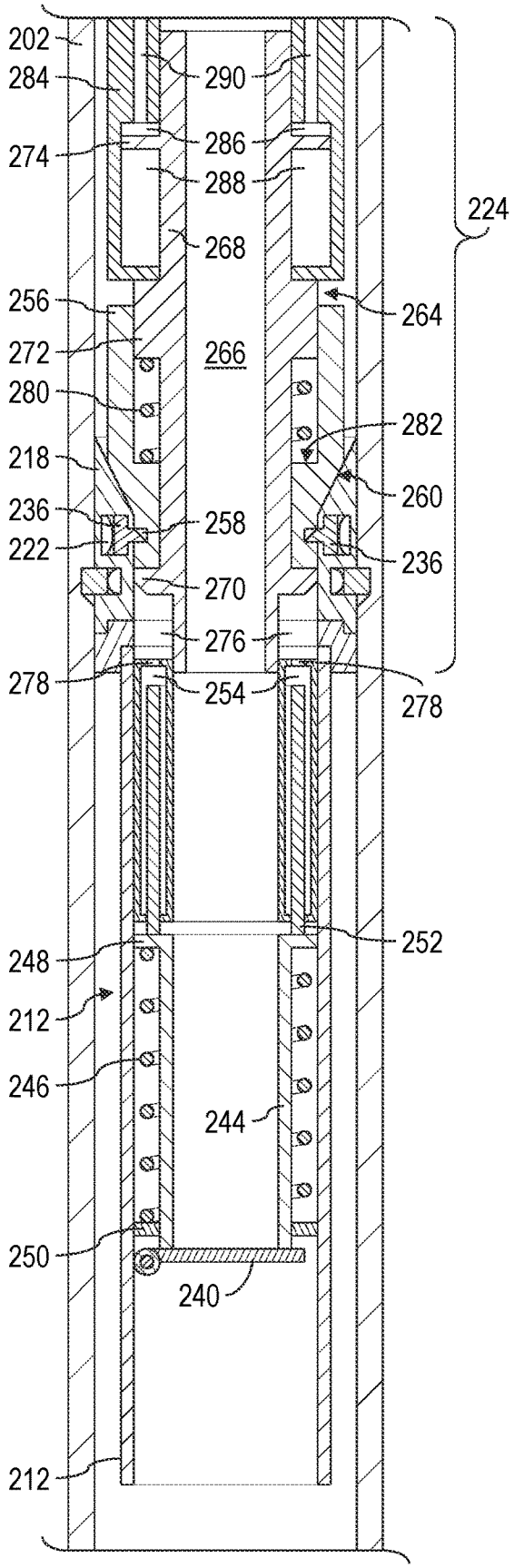
FIG. 7 is a sectional view of at least a portion of an example implementation of additional apparatus assembled with the apparatus shown in FIG. 6, representing another example implementation of the apparatus shown in FIG. 4, according to one or more aspects of the present disclosure.

In FIG. 7, an adapter 224 has been conveyed within the tubular 202 and mechanically and hydraulically coupled with the SCSSV subassembly 210. Prior to such conveyance, the adapter 224 may have been coupled (mechanically, electrically, and/or hydraulically) with a wireless actuator (not shown in FIG. 7, but at least similar to the wireless actuator 126 described above). The wireless actuator may be connected between the adapter 224 and a centralizer (not shown in FIG. 7, but at least similar to the centralizer 128 described above). The wireless actuator comprises a hydraulic pump and is operable to receive wireless (e.g., EM and/or acoustic) signals from surface equipment to operate the hydraulic pump.

The adapter 224 comprises a latch mandrel 256 that includes an outer recess 258. When the adapter 224 is being positioned within the lock mandrel 218, the engagement members 236 are urged radially outward until their biasing means urge the radially inward ends of the engagement members 236 into the recess 258, thus latching the adapter 224 to the SCSSV subassembly 210. The latch mandrel 256 may have a frustoconical outer surface 260 having a taper angle similar to a mating and/or otherwise corresponding frustoconical inner surface 262 (see FIG. 6) of the lock mandrel 218. The frustoconical surfaces 260, 262 may aid in guiding the adapter 224 into the SCSSV subassembly 210 and/or providing rigidity to the resulting assembly.

The adapter 224 also comprises an actuating piston 264 having an internal passage 266. In the example implementation depicted in FIG. 7, the actuating piston 264 comprises an elongated body 268 through which the internal passage 266 extends. External flanges 270, 272, 274 extend radially outward from the body 268. The flange 270 and/or the radially inward ends of the engagement members 236 may have slanted surfaces to aid in urging the engagement members radially outward into their respective recesses 222 while the adapter 224 is being positioned for latching to the SCSSV subassembly 210.

A downhole end of the actuating piston 264 forms a hydraulic coupling with the SCSSV subassembly 210. FIG. 7 is just one example implementation by which such hydraulic coupling may be achieved, it being understood that myriad other implementations for doing so are also within the scope of the present disclosure.

In the example implementation depicted in FIG. 7, latching the adapter 224 to the SCSSV subassembly 210 creates an annular pressure chamber 276 defined by external surfaces of the actuating piston body 268, one or more downhole-facing surfaces of the flange 270, and internal surfaces of the SCSSV subassembly 210. The pressure chamber 276 is fluidly connected with the pressure chamber 254 of the SCSSV subassembly 210 via one or more ports 278.

The actuating piston 264 is biased to the position depicted in FIG. 7. For example, a compression spring 280 (and/or other biasing means) may extend between a downhole-facing surface of the flange 272 and an uphole-facing shoulder 282 of the latch mandrel 256, thus urging the actuating piston 264 in an uphole direction relative to the latch mandrel 256.

The adapter 224 also comprises a mandrel 284. Internal surfaces of the mandrel 284, one or more external surfaces of the actuating piston body 268, and an uphole-facing surface of the flange 274 define an annular pressure chamber 286. Thus, the flange 274 is disposed below the pressure chamber 286 in a piston-like manner and is movable downward when the pressure in the pressure chamber 286 increases. The chamber 286 is in fluid communication with the hydraulic pump of the wireless actuator, such as via one or more conduits 290.

FIG. 8 depicts the actuating piston 264 having been moved axially in a downhole direction in response to activation of the hydraulic pump of the wireless actuator. That is, in response to receipt of a wireless signal coming from surface, the wireless actuator has activated the hydraulic pump to deliver hydraulic fluid to the pressure chamber 286, via the one or more conduits 290. The hydraulic fluid delivered to the pressure chamber 286 is of sufficient volume/pressure to overcome the biasing force of the spring 280, thereby increasing the volume of the pressure chamber 286.

The force resulting from the hydraulic fluid delivered to the pressure chamber 286 may also be sufficient to overcome the pressure of fluid in the pressure chamber 276. For example, the pressure of fluid in the pressure chamber 276 may initially be a first pressure, such as the pressure of fluid in the tubular 202 when the adapter 224 was being latched to the SCSSV subassembly 210 (e.g., at a point in time between the stages depicted in FIGS. 6 and 7), whereas the hydraulic fluid delivered to the pressure chamber 286 by the wireless actuator may be at a second pressure. The force created by the second pressure, which proportional to surface area of the pressure chamber 286 upon which the second pressure acts, is greater than the force created by the first pressure (again, proportional to the surface area of the 276) by an amount sufficient to permit downward movement of the actuating piston 264 relative to the rest of the adapter 224, thereby decreasing the volume of the pressure chamber 276.

Such movement of the actuating piston 264 transfers fluid in the pressure chamber 276 to the pressure chamber 254. The resulting increased volume of fluid in the pressure chamber 254 urges the piston 252 out of the pressure chamber 254, thereby overcoming the biasing force of the spring 246 and moving the flow tube 244 in the same direction through a distance sufficient to open the flapper 240. Thus, the actuating piston 264 operates to transfer the hydraulic pressure received from the wireless actuator to the pressure-actuated features of the SCSSV 212, even though the SCSSV 212 is not a wireless-actuated component. Accordingly, the adapter 224 permits the non-wireless SCSSV 212 to be actuated by the wireless actuator and thereby permit a flow path 242 extending through the SCSSV 212, the crossover 216, and the adapter 224, as described above with reference to FIG. 5, such that fluid in the tubular 202 downhole of the SCSSV 212 may flow uphole to the wellsite surface.

The SCSSV 212 may be returned to the closed position depicted in FIG. 7 by reversing the process described above. That is, when the wireless actuator stops delivering (or decreases) the hydraulic pressure to the adapter 224, the spring 280 urges the actuating piston 264 toward the position shown in FIG. 7, thereby decreasing the pressure in the chamber 254 such that the spring 246 can urge the piston 252 and the flow tube 244 toward their positions shown in FIG. 7. Thus, when the wireless actuator stops delivering the hydraulic opening force to the adapter 224, the spring-loaded flapper 240 is permitted to return to the position shown in FIG. 7, thereby closing the SCSSV 212.

Figure 9:
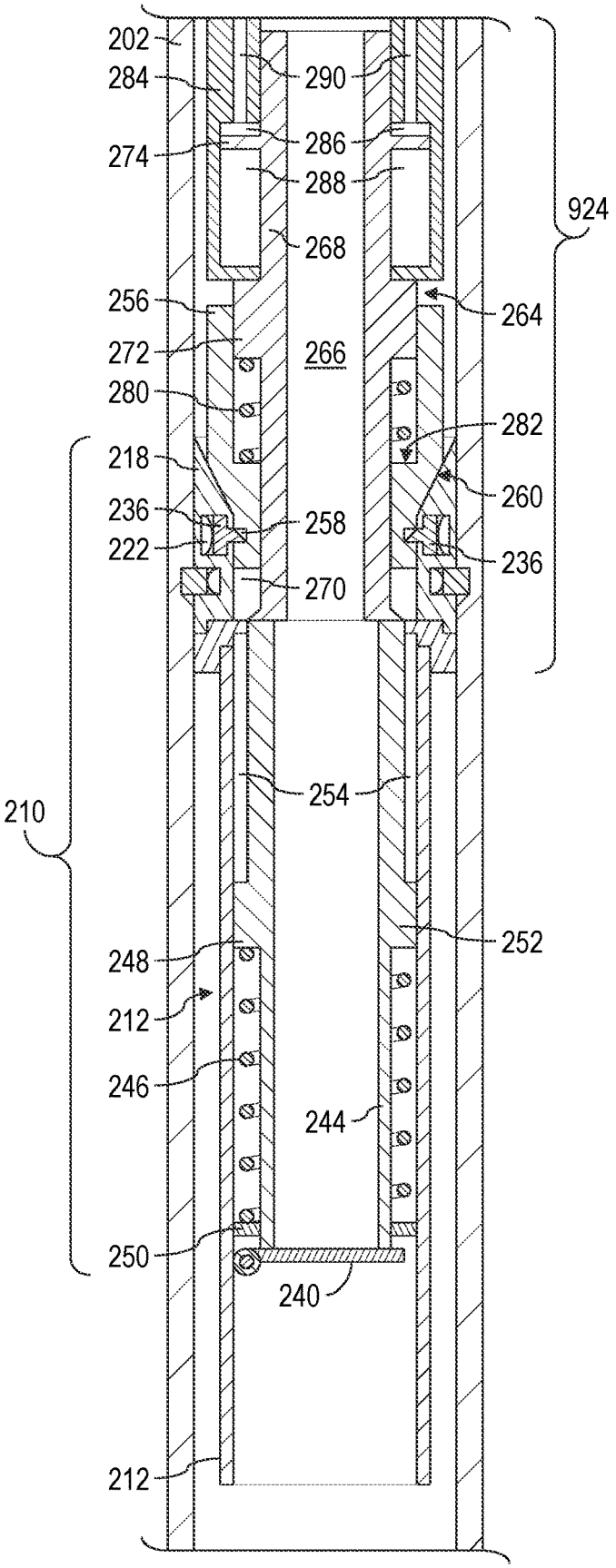
FIG. 9 is a sectional view of at least a portion of another example implementation of the apparatus shown in FIG. 7.

FIG. 9 is a sectional view of at least a portion of another example implementation of the apparatus shown in FIG. 7, in which an adapter 924 is similar or identical to the adapter 224 shown in FIG. 7 except as described below and shown in FIG. 9. For example, the adapter 924 is not hydraulically connected (or in fluid communication) with the SCSSV subassembly 210, and there are no fluid chambers 254 and 276. The piston 252 is moved mechanically by a force exerted due to mechanical contact with an actuating piston 264, which is otherwise similar or identical to the piston 264 shown in FIG. 7.

An adapter according to one or more aspects of the present disclosure, such as the adapter 224 shown in FIG. 7 and the adapter 924 shown in FIG. 9, may permit retrofitting the actuator on existing subsurface valves. Various valve subassemblies may then be equipped with an actuator that permits wireless communication and command from the surface, and the wireless actuation may be used with various tubing sizes and/or pressure ratings. This may necessitate changing a conventional crossover to attach the valve with an anchor subassembly (e.g., anchor subassembly 114 described above) by a crossover that is compatible with the adapter.

In view of the entirety of the present disclosure, including the figures and the claims, a person having ordinary skill in the art will readily recognize that the present disclosure introduces an apparatus comprising: an adapter mechanically connecting a wireless actuator to an SCSSV subassembly that comprises an SCSSV, wherein the adapter is operable to mechanically connect to the SCSSV subassembly so that the adapter is situated uphole of the SCSSV subassembly when set in a tubular of a wellbore; and an actuating piston carried by the adapter and operable to transfer an opening force to the SCSSV in response to receipt by the adapter of pressurized fluid from the wireless actuator, thereby opening a flapper of the SCSSV.

The actuating piston may be configured to transfer the opening force via mechanical contact or hydraulic pressure.

The actuating piston may be biased toward a first position and movable toward a second position in response to receipt by the adapter of the pressurized fluid from the wireless actuator. The actuating piston may be a single discrete member.

The adapter may comprise a mandrel and the actuating piston may comprise: a body; a first flange extending radially outward from the body and into a recess of the mandrel, thereby defining a first chamber within the recess and fluidly connected to the wireless actuator for receiving the pressurized fluid; and a second flange extending radially outward from the body and at least partially defining a second chamber fluidly connected to a third chamber of the SCSSV subassembly. Receipt of the pressurized fluid in the first chamber may: volumetrically increase the first chamber; volumetrically decrease the second chamber; and urge a piston out of the third chamber, thereby opening the flapper. The actuating piston may further comprise a third flange and the adapter may further comprise a spring abutting the third flange and biasing the actuating piston toward the first position.

The SCSSV subassembly may further comprise an anchor subassembly and a crossover, the crossover may couple the SCSSV with the anchor subassembly, the anchor subassembly may anchor the SCSSV subassembly in the tubular, and the adapter may be connected to the crossover, thereby connecting the wireless actuator to the SCSSV subassembly. The crossover may comprise a plurality of engagement members engaged with one or more corresponding recesses of the adapter and/or the adapter may comprise a plurality of engagement members engaged with one or more corresponding recesses of the crossover.

The adapter may comprise: a first fluid path for receiving the pressurized fluid from the wireless actuator; and a second fluid path extending through the adapter for communicating an additional fluid through the SCSSV. The SCSSV subassembly may further comprise an anchor subassembly and a crossover, the crossover may couple the SCSSV with the anchor subassembly, the anchor subassembly may anchor the SCSSV subassembly in the tubular, the adapter may be connected to the crossover, and the second fluid path may extend through the SCSSV, the crossover, and the adapter, and then into the tubular via exit ports of the adaptor.

The present disclosure also introduces a system comprising: an SCSSV subassembly comprising an SCSSV, a fluid passage, and a flapper, wherein the flapper is movable between an open position in which the flapper opens the fluid passage and a closed position in which the flapper closes the fluid passage; a wireless actuator comprising a hydraulic actuator and a control unit for controlling the hydraulic actuator based on wireless signals received via a receiver electrically connected to the control unit; an adapter mechanically connecting the wireless actuator to the SCSSV subassembly, wherein the adapter is operable to mechanically connect to the SCSSV subassembly so that the adapter is situated uphole of the SCSSV subassembly when set in a tubular of a wellbore; and an actuating piston carried by the adapter and operable to transfer an opening force to the SCSSV in response to receipt by the adapter of pressurized fluid from the wireless actuator, thereby moving the flapper to the open position.

The actuating piston may be biased toward a first position and movable toward a second position in response to receipt by the adapter of the pressurized fluid from the wireless actuator.

The adapter may comprise a mandrel and the actuating piston may comprise: a body; a first flange extending radially outward from the body and into a recess of the mandrel, thereby defining a first chamber within the recess and fluidly connected to the wireless actuator for receiving the pressurized fluid; and a second flange extending radially outward from the body and at least partially defining a second chamber fluidly connected to a third chamber of the SCSSV subassembly. Receipt of the pressurized fluid in the first chamber may: volumetrically increase the first chamber; volumetrically decrease the second chamber; and urge a piston out of the third chamber, thereby moving the flapper to the open position.

The SCSSV subassembly may further comprise an anchor subassembly and a crossover, the crossover may couple the SCSSV with the anchor subassembly, the anchor subassembly may anchor the SCSSV subassembly in the tubular, and the adapter may be connected to the crossover, thereby connecting the wireless actuator to the SCSSV subassembly. A first one of the crossover and the adapter may comprise a plurality of engagement members engaged with one or more corresponding recesses of a second one of the crossover and the adapter.

The present disclosure also introduces a method comprising transmitting a wireless signal to a wireless actuator in a tubular of a wellbore, thereby causing the wireless actuator to communicate pressurized fluid to an adapter, wherein: the adapter mechanically connects the wireless actuator to an SCSSV subassembly that comprises an SCSSV; and the adapter comprises an actuating piston operable to transfer an opening force to the SCSSV in response to receipt by the adapter of the pressurized fluid from the wireless actuator, thereby opening the SCSSV.

The method may further comprise, prior to transmitting the wireless signal, conveying the wireless actuator and the adapter, collectively, within the tubular and then latching the adapter to the SCSSV subassembly previously installed in the tubular. The method may further comprise, prior to conveying the wireless actuator and the adapter within the tubular, installing the SCSSV subassembly in the tubular.

The present disclosure also introduces an apparatus comprising: an adapter mechanically connecting a wireless actuator to an SCSSV subassembly, wherein the SCSSV subassembly comprises a hydraulically operated SCSSV not configured for wireless actuation; and an actuating piston carried by the adapter and operable to transfer an opening force to the SCSSV in response to receipt by the adapter of pressurized fluid from the wireless actuator, thereby opening the SCSSV.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus comprising:

an adapter mechanically connecting a wireless actuator to a surface-controlled subsurface safety valve (SCSSV) subassembly that comprises an SCSSV installed in a tubular of a wellbore, wherein the adapter is operable to be conveyed into the wellbore and to mechanically connect to the previously installed SCSSV subassembly so that the adapter is situated uphole of the SCSSV subassembly when set in the tubular of the wellbore; and an actuating piston carried by the adapter and operable to transfer an opening force to the SCSSV in response to receipt by the adapter of pressurized fluid from the wireless actuator, thereby opening a flapper of the SCSSV.

2. The apparatus of claim 1 wherein the actuating piston is configured to transfer the opening force via mechanical contact or hydraulic pressure.

3. The apparatus of claim 1 wherein the actuating piston is biased toward a first position and movable toward a second position in response to receipt by the adapter of the pressurized fluid from the wireless actuator.

4. The apparatus of claim 1 wherein the adapter comprises a mandrel, and wherein the actuating piston comprises:

a body;

a first flange extending radially outward from the body and into a recess of the mandrel, thereby defining a first chamber within the recess and fluidly connected to the wireless actuator for receiving the pressurized fluid; and a second flange extending radially outward from the body and at least partially defining a second chamber fluidly connected to a third chamber of the SCSSV subassembly.

5. The apparatus of claim 4 wherein receipt of the pressurized fluid in the first chamber:

volumetrically increases the first chamber;

volumetrically decreases the second chamber; and urges a piston out of the third chamber, thereby opening the flapper.

6. The apparatus of claim 4 wherein:

the actuating piston further comprises a third flange; and the adapter further comprises a spring abutting the third flange and biasing the actuating piston toward the first position.

7. The apparatus of claim 1 wherein:

the SCSSV subassembly further comprises an anchor subassembly and a crossover;

the crossover couples the SCSSV with the anchor subassembly;

the anchor subassembly anchors the SCSSV subassembly in the tubular; and the adapter is connected to the crossover.

8. The apparatus of claim 7 wherein the crossover comprises a plurality of engagement members engaged with one or more corresponding recesses of the adapter.

9. The apparatus of claim 7 wherein the adapter comprises a plurality of engagement members engaged with one or more corresponding recesses of the crossover.

10. The apparatus of claim 1 wherein the adapter comprises:

a first fluid path for receiving the pressurized fluid from the wireless actuator; and a second fluid path extending through the adapter for communicating an additional fluid through the SCSSV.

11. The apparatus of claim 10 wherein:

the SCSSV subassembly further comprises an anchor subassembly and a crossover;

the crossover couples the SCSSV with the anchor subassembly;

the anchor subassembly anchors the SCSSV subassembly in the tubular;

the adapter is connected to the crossover; and the second fluid path extends through the SCSSV, the crossover, and the adapter, and then into the tubular via exit ports of the adapter.

12. A system comprising:

a surface-controlled subsurface safety valve (SCSSV) subassembly comprising an SCSSV, a fluid passage, and a flapper, wherein the flapper is movable between:

an open position in which the flapper opens the fluid passage; and a closed position in which the flapper closes the fluid passage;

a wireless actuator comprising:

a hydraulic actuator; and a control unit for controlling the hydraulic actuator based on wireless signals received via a receiver electrically connected to the control unit;

an adapter mechanically connecting the wireless actuator to the SCSSV subassembly, wherein the adapter is operable to mechanically connect to the SCSSV subassembly so that the adapter is situated uphole of the SCSSV subassembly when set in a tubular of a wellbore; and an actuating piston carried by the adapter and operable to transfer an opening force to the SCSSV in response to receipt by the adapter of pressurized fluid from the wireless actuator, thereby moving the flapper to the open position, wherein the SCSSV subassembly further comprises an anchor subassembly and a crossover;

the crossover couples the SCSSV with the anchor subassembly;

the anchor subassembly anchors the SCSSV subassembly in the tubular; and the adapter is connected to the crossover.

13. The system of claim 12 wherein the actuating piston is biased toward a first position and movable toward a second position in response to receipt by the adapter of the pressurized fluid from the wireless actuator.

14. The system of claim 12 wherein the adapter comprises a mandrel, and wherein the actuating piston comprises:

a body;

a first flange extending radially outward from the body and into a recess of the mandrel, thereby defining a first chamber within the recess and fluidly connected to the wireless actuator for receiving the pressurized fluid; and a second flange extending radially outward from the body and at least partially defining a second chamber fluidly connected to a third chamber of the SCSSV subassembly.

15. The system of claim 14 wherein receipt of the pressurized fluid in the first chamber:

volumetrically increases the first chamber;

volumetrically decreases the second chamber; and urges a piston out of the third chamber, thereby moving the flapper to the open position.

16. The system of claim 12 wherein a first one of the crossover and the adapter comprises a plurality of engagement members engaged with one or more corresponding recesses of a second one of the crossover and the adapter.

17. A method comprising:

conveying a wireless actuator and an adapter, collectively, within a tubular of a wellbore;

latching the adapter to a surface-controlled subsurface safety valve (SCSSV) subassembly that comprises an SCSSV, the SCSSV subassembly previously installed in the tubular; and transmitting a wireless signal to the wireless actuator, thereby causing the wireless actuator to communicate pressurized fluid to the adapter, wherein:

the adapter comprises an actuating piston operable to transfer an opening force to the SCSSV in response to receipt by the adapter of the pressurized fluid from the wireless actuator, thereby opening the SCSSV.

18. The method of claim 17 further comprising, prior to conveying the wireless actuator and the adapter within the tubular, installing the SCSSV subassembly in the tubular.

* * * * *